US005636817A

United States Patent [19]

Beachy

[11] Patent Number: 5,636,817

[45] Date of Patent: Jun. 10, 1997

[54] COMBINATION CAN AND TOOL SUPPORT

[76] Inventor: Marvin E. Beachy, P.O. Box 191 105 Main St., Grantsville, Md. 21536

[21] Appl. No.: 587,219

[22] Filed: Jan. 16, 1996

[51] Int. Cl.[6] ..... E06C 7/00

[52] U.S. Cl. ..... 248/210; 182/129; 248/238

[58] Field of Search ..... 248/210, 238, 248/228.5, 228.6, 311.2, 126, 146; 211/70.6, 71; 182/129

[56] References Cited

U.S. PATENT DOCUMENTS

| | | | |
|---|---|---|---|
| D. 274,363 | 6/1984 | Brownlee, Jr. | D25/68 |
| 1,909,999 | 5/1933 | Billman | 248/146 |
| 2,308,180 | 1/1943 | Larson et al. | 182/129 |
| 2,982,982 | 5/1961 | Swift, Sr. | 248/311.2 |
| 3,642,239 | 2/1972 | Zular, Jr. | 248/146 |
| 4,016,955 | 4/1977 | Gates | 182/122 |
| 4,702,446 | 10/1987 | Brown | 248/210 |
| 5,120,013 | 6/1992 | Sweeney | 248/238 |
| 5,123,620 | 6/1992 | Bourne | 248/210 |
| 5,145,226 | 9/1992 | LaFontaine | 294/27.1 |
| 5,333,823 | 8/1994 | Joseph | 248/210 |

*Primary Examiner*—Alvin C. Chin-Shue
*Assistant Examiner*—Kimberly T. Wood
*Attorney, Agent, or Firm*—Norton R. Townsley

[57] ABSTRACT

The present invention has a top plate with a receptacle and handle on its top surface, a bottom plate with cut-outs for holding tools, a fastener assembly for screwing the top plate to the bottom plate and a demountable leg assembly. The receptacle is designed to closely hold a gallon can. An insert enables the receptacle to hold smaller cans. When used with the leg assembly attached to the top plate, the top plate is screwed tightly against the bottom plate. The invention is designed so that the top plate does not interfere with the cut-outs. Preferably the legs telescope so that the invention can be placed on uneven surfaces and the height of the receptacle can be varied. When used without the leg assembly, the top plate is screwed to the bottom plate around any convenient horizontal support member. The screws force the top and bottom plate to clamp securely to the member. The member can be the rung of a ladder or the step of a step ladder. While designed primarily for the use of painters, this invention can be used by other tradesmen who need to carry and support a can of material and some tools at a convenient working height above the floor or ground.

18 Claims, 4 Drawing Sheets

COMBINATION CAN AND TOOL SUPPORT

BACKGROUND OF THE INVENTION

The present invention relates to the field of tools and more particularly holders for tools and cans of paint and the like.

When painting houses, offices and other buildings it is essential to have can of paint, spackle, etc., brushes, and some tools (like a screwdriver, hammer and putty knife) close at hand. In order to satisfy this need, painters hand-carry these items or, if working on a straight or extension ladder, hang them to a rung by means special hooks designed for this purpose. If using a step ladder, painters can lay these items on the step or tool tray. Even when painting at ground level, placing such items on the platform or shelf of a platform ladder or on the step of a step stool obviates the need for frequent bending.

Gallon cans of paint are usually provided with a bail made of thin metal wire. Cans smaller than one gallon in size do not usually have bails. A person cannot easily hold the bail of a gallon can or cans smaller than one gallon for long periods of time. The specially designed hooks do not hold the cans of paint really steady thus allowing the cans to tilt and paint to spill. Furthermore, it is easy to knock cans of paint and tools off steps, tool trays, platforms or steps. Dropped cans of paint cause messes which are not easy to clean. Dropped tools can be broken and may even cause injuries to persons working beneath the painter.

Development of a can and tool holder which can securely hold the cans and tools at any distance above the ground or floor, or which can be clamped to a ladder or other horizontal support member represents a great improvement in the field of tool design and satisfies a long felt need of the painter and similar tradesman.

SUMMARY OF THE INVENTION

The present invention is a can and tool holder which can securely support cans of paint or similar materials and tools at any distance above the ground or floor, or which can be clamped to a ladder or other horizontal support member. The present invention has a top plate with a receptacle and handle on its top surface, a bottom plate with cut-outs for holding tools, means for screwing the top plate to the bottom plate and a demountable leg assembly. The receptacle is designed to closely hold a gallon can. An insert enables the receptacle to hold smaller cans.

When used with the leg assembly attached to the top plate, the top plate is screwed tightly against the bottom plate. The invention is designed so that the top plate does not interfere with the cut-outs. Preferably the legs telescope so that the invention can be placed on uneven surfaces and the height of the receptacle can be varied.

When used without the leg assembly, the top plate is screwed to the bottom plate around any convenient horizontal support member. The screws force the top and bottom plate to clamp securely to the member. The member can be the rung of a ladder or the step of a step ladder. While designed primarily for the use of painters, this invention can be used by other tradesmen who need to carry and support a can of material and some tools at a convenient working height above the floor or ground.

An appreciation of the other aims and objectives of the present invention and an understanding of it may be achieved by referring to the accompanying drawings description of a preferred embodiment.

DETAILED DESCRIPTION OF THE PREFERRED EMBODIMENT

Figure 1:
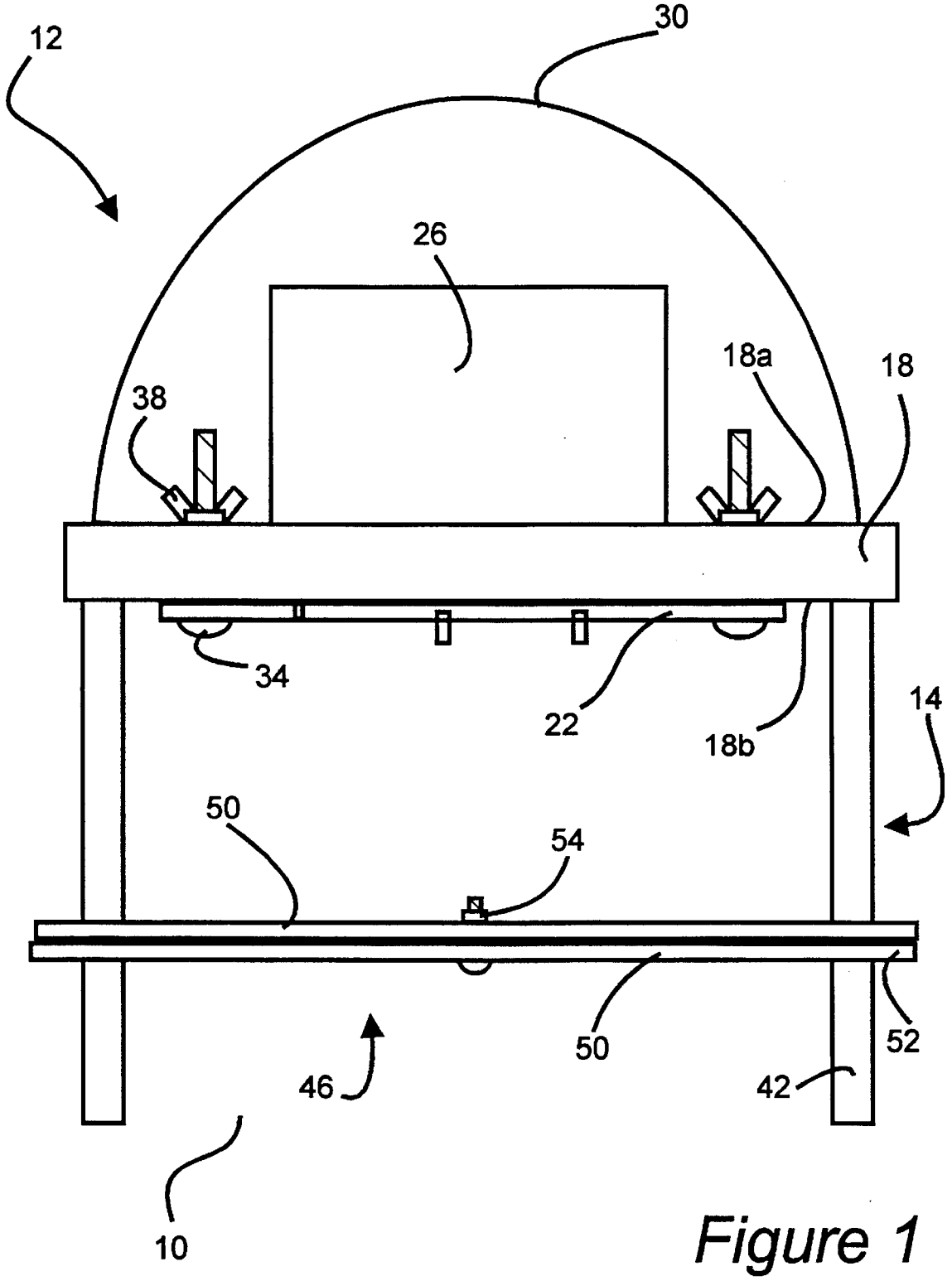
FIG. 1 is a front view of the can and tool support with its demountable legs.

FIG. 1 is a front view of the invention 10. FIG. 1 shows the support portion 12 attached to the demountable leg assembly 14. The support portion 12 has a top plate 18 which has a top surface 18*a* and a bottom surface 18*b*. In this invention, the top plate 18 functions similarly to one jaw of a clamp. Attached to the top surface 18*b* is a receptacle 26. The receptacle 26 is designed to snugly hold a can of paint or similar material. Also attached to the top surface 18*a* is handle 30. Preferably the handle 30 is foldable. In other words, the handle 30 operates in a manner similar to the bail of a bucket or gallon paint can. This means that the handle 30 can be lifted and used for carrying or allowed to fall flat against the top surface 18*a*.

Screwed to the bottom surface 18*b* is a bottom plate 22. In this invention, the bottom plate 22 functions similarly to the other jaw of a clamp. FIG. 1 shows attachment by means of bolts 34 and wing nuts 38. Two wing nut 38 and bolt 38 combinations have been found sufficient to provide adequate clamping power. However the exact method of attachment is not critical to the invention 10 so long as the top 18 and bottom 22 plates can be assembled and disassembled from each other. For example the wing nuts 38 could be replaced by any other form of nuts, or threaded inserts.

The leg assembly 14 is shown on FIG. 1 as having four legs 42 and a cross brace assembly 46. As shown on the Figure, the cross brace assembly 46 comprises two braces 50, through the ends 52 of which the legs 42 pass at right angles. The braces 50 are loosely screwed together by a nut/bolt combination 54 at their centers. However, the exact configuration of the leg assembly is not critical to the invention 10. Any leg assembly 14 known to mechanical designers can be used so long as the assembly 14 can be easily assembled and disassembled from the top plate 18. Preferably, the leg assembly 14 includes telescoping legs 42 or some other length adjusting feature. In this way the top plate 18, and consequently the receptacle 26, can be placed at any convenient height. Also telescoping legs 42 or other length adjusting feature can be used to compensate for irregularities in the surface on which the invention 10 is placed.

Figure 2:
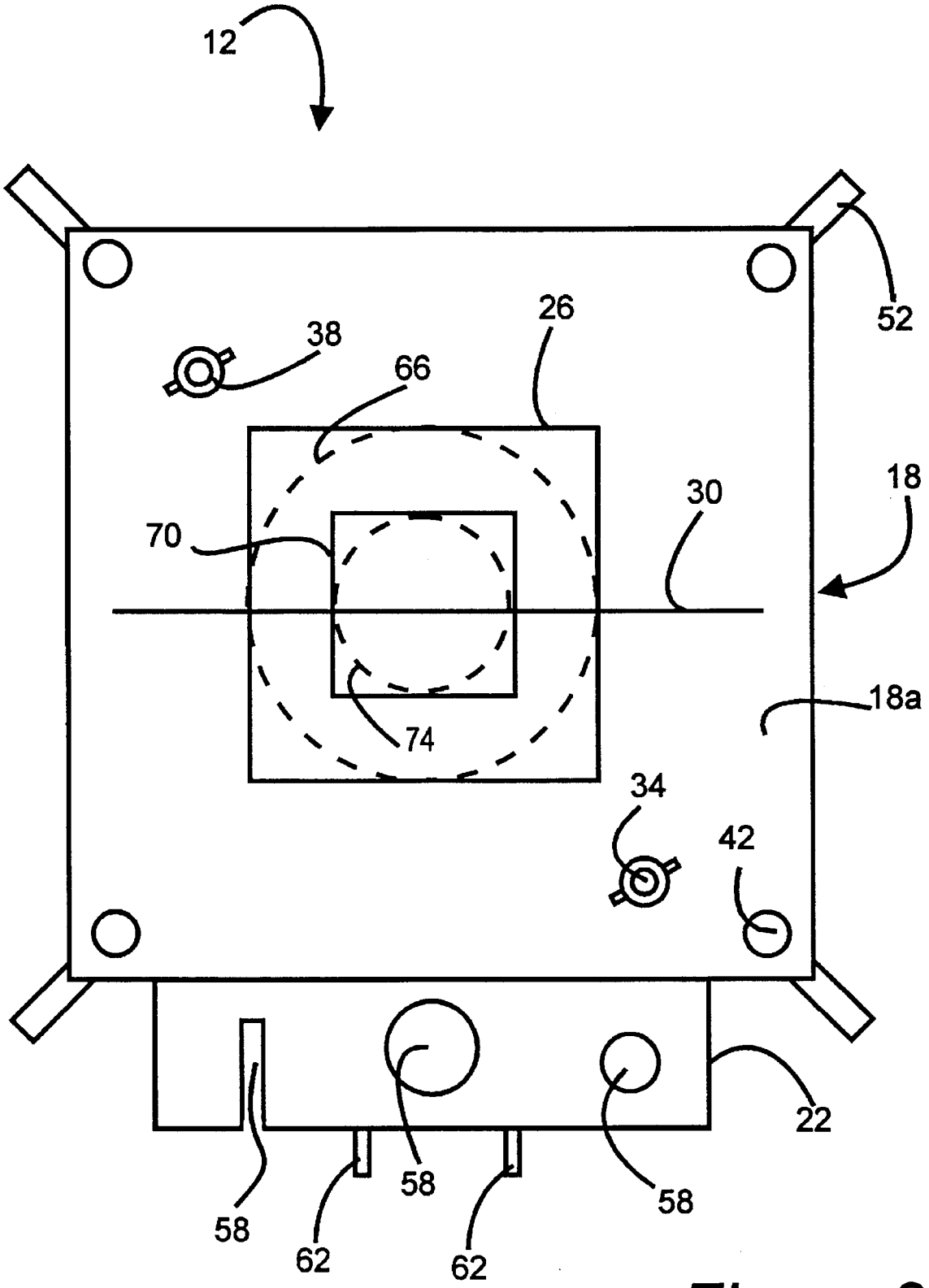
FIG. 2 is a top view of the can and tool support with its demountable legs.

FIG. 2 is a top view of the invention 10. Again, this Figure shows the support portion 12 attached to the demountable leg assembly 14. However, the only portions of the leg assembly 14 visible in this view are the tops of the legs 42 and the ends 52 of the cross braces 50.

In FIG. 2 the cut-outs 58 in the bottom plate 22 can be clearly seen. The cut-outs are designed to hold tools such as hammers, screw drivers and putty knives. FIG. 2 shows a square top plate 18 and a rectangular bottom plate 22. However, the exact shapes of these plates 18, 22 is not critical. What is critical is that the top plate 18 not interfere with the cut-outs 58. If there were interference then tools could not be inserted into the cut-outs. The bottom plate 22 can also be provided with hooks 62. These can be used to hang tools with holes in their handles, such as paint brushes.

FIG. 2 also illustrates a 1 gallon paint can 66, snugly held in the receptacle 26. The receptacle 26 can be modified with an insert 70 to hold a quart or other size paint can 74. Designing the invention 10 to hold cans larger than 1 gallon is probably unwise because of possibility of injury to personnel in lifting such heavy containers and the possibility of unbalancing ladders.

The cross sections of the receptacle 26 and insert 70 are shown as square but the exact shape is not critical. The receptacle 26 and insert 70 could be circular, hexagonal or any other convenient shape. The important thing is that the receptacle 26 and insert 70 snugly hold the can 66 or 74.

The receptacle 26 is illustrated centrally located on the top plate 18. However, exact placement is not critical. Indeed, as will be further explained in relation to FIG. 3, an off center placement of the receptacle might be desirable.

Figure 3:
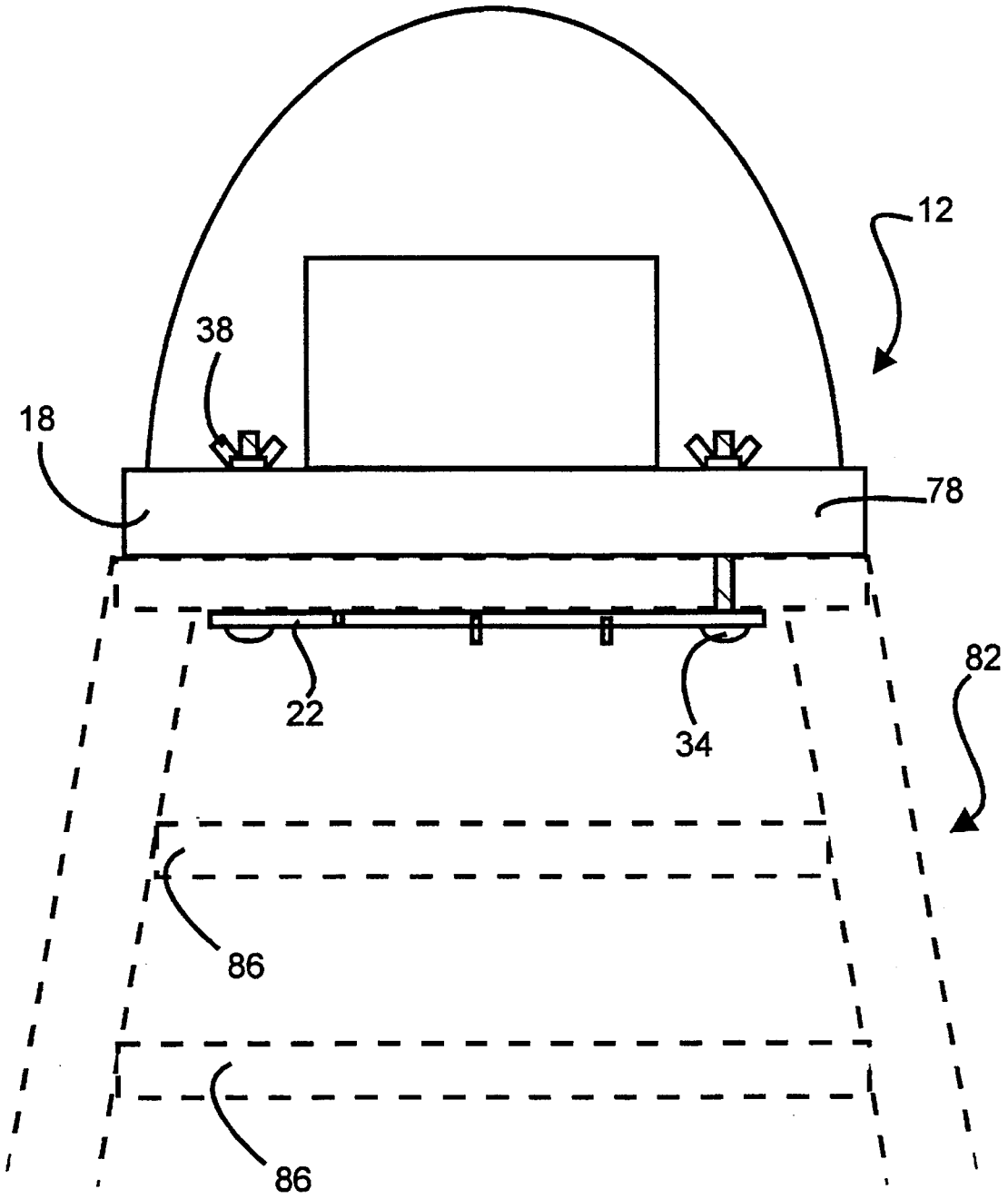
FIG. 3 is a front view of the can and tools support clamped to the top step of a step ladder.

FIG. 3 is a front view of the support section 12 clamped to the top step 78 of a step ladder 82. In this method of use, the top plate 18 is screwed to the bottom plate 22 around the top step 78. Use of the nut 38 and bolt 34 combinations makes this possible. While the invention 12 is shown attached to the top step 78, the invention 10 could be attached to any step 86 of the ladder 82. To facilitate attachment of the invention 10 to any step 86, it may be necessary to locate the receptacle off center.

Figure 4:
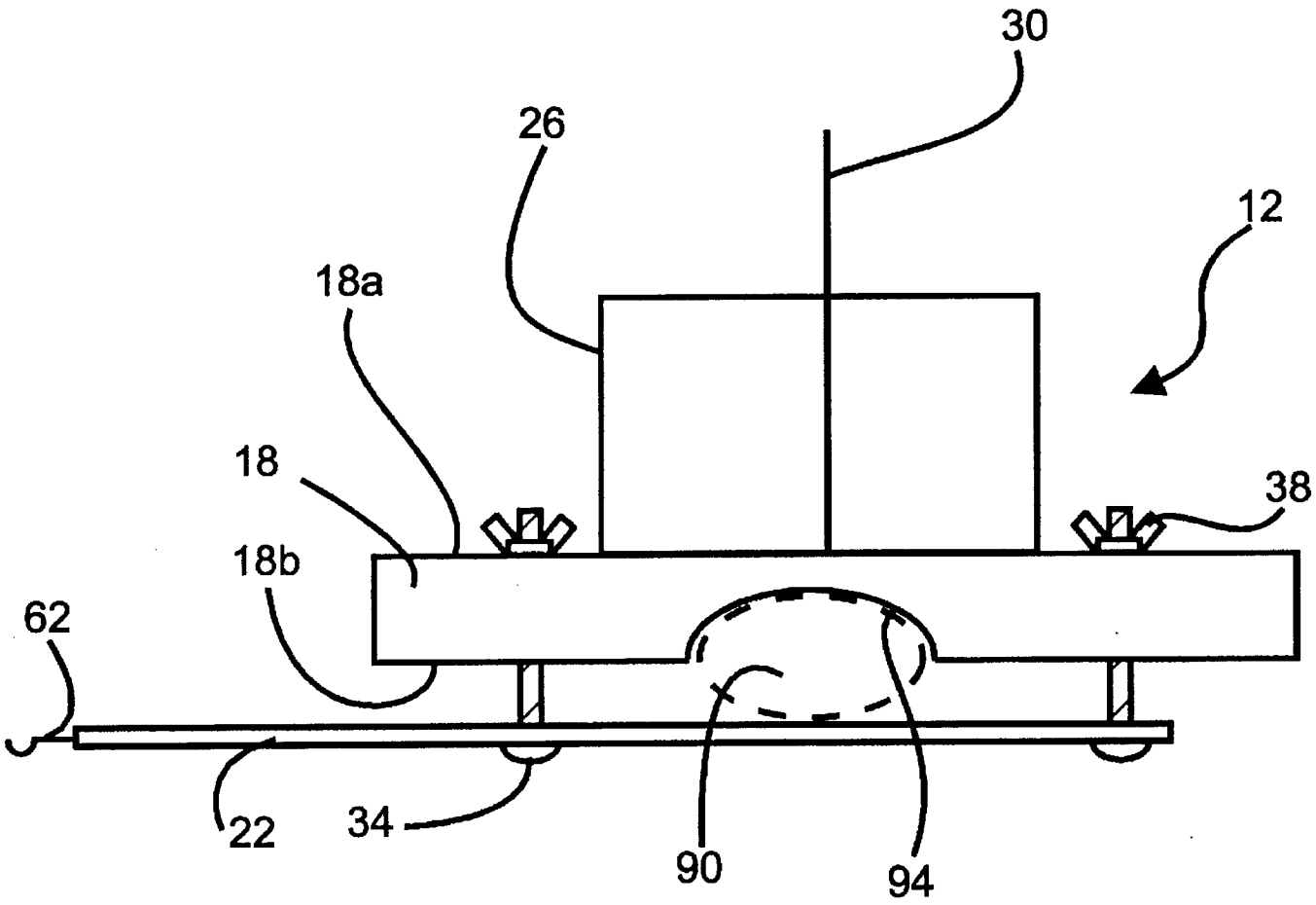
FIG. 4 is a side view of the can and tool support clamped to the rung of a straight or extension ladder.

FIG. 4 is a side view of the support portion 12 clamped to the rung 90 of a straight or extension ladder. From this view it can be seen that the top plate 18 has an elliptical depression 94 in its lower surface 18*b*. In this way the invention 12 can be securely clamped to rungs 90 of different cross-sectional shapes. For ease of illustration, an elliptical depression 94 is shown. It will be clearly understood by those to whom this invention pertains, that any other shape that will accommodate rungs 90 of differing cross-sections can be utilized. Also, it will be clearly understood, that, while the depression 94 is shown in the top plate 18, it could be designed into the bottom plate 22 or into both plates 18, 22.

The invention 10 can be made of wood, plastic, steel, or any other convenient structural material. While the above description refers mostly to use of this invention in painting, it should be clearly understood that this invention would also be useful for plasterers and others in the construction trades. Therefore, this invention could be used to support cans of spackle, patching plaster, wallboard paste, roofing cement and similar construction materials.

The can and tool support 10 has been described with reference to a particular embodiment and several modifications. Other modifications and enhancements can be made without departing from the spirit and scope of the claims that follow.

What is claimed is:

1. A combination can and tool support which can be used free-standing or in conjunction with a separate horizontal support member comprising:

a. an openable and closeable clamp having a top jaw and a bottom jaw; said top jaw having an upper surface; said bottom jaw having a cut out for holding a tool; said top jaw not interfering with access to said cut out;

b. a receptacle affixed to said upper surface; said receptacle adapted to receive a can;

c. demountable leg means for supporting said top jaw horizontally above any surface.

2. A combination can and tool support as claimed in claim 1 further comprising a size adjusting means for adjusting the internal size of said receptacle, whereby differing sizes of cans can be accommodated within said receptacle.

3. A combination can and tool support as claimed in claim 1 in which said separate horizontal support member is the top platform of a step ladder.

4. A combination can and tool support as claimed in claim 1 in which said separate horizontal support member is the rung of a ladder.

5. A combination can and tool support as claimed in claim 1 further comprising a hook for supporting another tool; said hook affixed to said bottom jaw.

6. A combination can and tool support as claimed in claim 1 further comprising a handle attached to said upper surface.

7. A combination can and tool support which can be used free-standing or in conjunction with a separate horizontal support member comprising:

a. a top plate having an upper surface;

b. a receptacle affixed to said upper surface; said receptacle adapted to receive a can;

c. a bottom plate having a cut out for holding a tool;

d. demountable leg means for supporting said top plate horizontally above any surface; and e. clamp means for fastening said top plate to said bottom plate so that said top plate and said bottom plate can be assembled to each other, said top plate and said bottom plate can be disassembled from each other, the space between said top plate and said bottom plate can be varied, and access to said cut out is not blocked by said top plate;

whereby said top plate can be fastened immediately adjacent to said bottom plate when said combination can and tool support is used attached to said demountable leg means, and said top plate can be fastened to said bottom plate around said separate horizontal support member when said combination can and tool support is used without said demountable leg means.

8. A combination can and tool support as claimed in claim 7 further comprising a size adjusting means for adjusting the internal size of said receptacle, whereby differing sizes of cans can be accommodated within said receptacle.

9. A combination can and tool support as claimed in claim 7 in which said separate horizontal support member is the top platform of a step ladder.

10. A combination can and tool support as claimed in claim 7 in which said separate horizontal support member is the rung of a ladder.

11. A combination can and tool support as claimed in claim 7 further comprising a hook for supporting another tool; said hook affixed to said bottom plate.

12. A combination can and tool support as claimed in claim 7 further comprising a handle attached to said upper surface.

13. A combination can and tool support which can be used free-standing or in conjunction with a separate horizontal support member comprising:

a. a top plate having an upper surface and a bolt hole;

b. a holder affixed to said upper surface; said holder adapted to receive a can;

c. a handle attached to said upper surface;

d. a bottom plate having a cut out for holding a tool and a bolt hole;

e. a demountable support assembly for supporting said top plate horizontally above any surface; and f. a bolt which can be passed through said bolt holes; said bolt holes being located so that, when said top plate is bolted to said bottom plate, access to said cut out is not blocked by said top plate; said bolt having a long threaded shank;

g. a nut which can be screwed onto and removed from the protruding threaded shank of said bolt;

whereby said top plate can be bolted immediately adjacent to said bottom plate when said combination can and tool support is used attached to said demountable support assembly, and said top plate can be bolted to said bottom plate around said separate horizontal support member when said combination can and tool support is used without said remountable support assembly.

14. A combination can and tool support as claimed in claim 13 further comprising a size adjusting means for adjusting the internal size of said holder, whereby differing sizes of cans can be accommodated within said holder.

15. A combination can and tool support as claimed in claim 13 in which said separate horizontal support member is the top platform of a step ladder.

16. A combination can and tool support as claimed in claim 13 in which said separate horizontal support member is the rung of a ladder.

17. A combination can and tool support as claimed in claim 13 further comprising a hook for supporting another tool; said hook affixed to said bottom plate.

18. A combination can and tool support as claimed in claim 13 in which said handle is foldable.

* * * * *